US011045675B2

(12) United States Patent
Archibald et al.

(10) Patent No.: US 11,045,675 B2
(45) Date of Patent: Jun. 29, 2021

(54) BELLEVILLE SEAL FOR VALVE SEAT HAVING A TEAR DROP LAMINAR FLOW FEATURE

(71) Applicant: Globe Fire Sprinkler Corporation, Standish, MI (US)

(72) Inventors: Thomas Edwin Archibald, Midland, MI (US); Yoram Ringer, Providence, RI (US); Stephen J. Meyer, Chester Springs, PA (US)

(73) Assignee: VICTAULIC COMPANY, Easton, PA (US)

( * ) Notice: Subject to any disclaimer, the term of this patent is extended or adjusted under 35 U.S.C. 154(b) by 0 days.

(21) Appl. No.: 16/267,288

(22) Filed: Feb. 4, 2019

(65) Prior Publication Data

US 2019/0240519 A1 Aug. 8, 2019

Related U.S. Application Data

(60) Provisional application No. 62/625,842, filed on Feb. 2, 2018, provisional application No. 62/782,788, filed on Dec. 20, 2018.

(51) Int. Cl.
*A62C 35/68* (2006.01)
*A62C 37/38* (2006.01)
(Continued)

(52) U.S. Cl.
CPC ..... *A62C 35/68* (2013.01); *A62C 35/62* (2013.01); *A62C 37/11* (2013.01); *A62C 37/38* (2013.01); *A62C 37/42* (2013.01)

(58) Field of Classification Search
CPC ..... A62C 35/68; A62C 35/62; A62C 37/11; A62C 37/38; A62C 37/42
(Continued)

(56) References Cited

U.S. PATENT DOCUMENTS 1,182,460 A 5/1916 Cruger
2,251,422 A 8/1941 Rider
(Continued)

FOREIGN PATENT DOCUMENTS

CN 103845836 A 6/2014
DE 20209353 U1 11/2002
(Continued)

OTHER PUBLICATIONS

Series MJC Multiple Jet Controls DN20, DN25, DN50, 12 Bar BSPT Inlet & Outlets Threads, TYCO Fire Products Data Sheet, Oct. 2014, downloaded from web page: http://www.tyco-fire.com/TD_TFP/TFP/TFP1346_10_2014.pdf, Download Date: May 24, 2016, original posting date: uknown, 10 pages.
(Continued)

*Primary Examiner* — Chee-Chong Lee
(74) *Attorney, Agent, or Firm* — Panitch Schwarze Bellisario & Nadel LLP

(57) ABSTRACT

A fire-protection system for delivering a fire-control fluid includes a valve having a body with an inlet, an outlet, and a fluid passageway connecting the inlet with the outlet. A seal member is supportable across the passageway to close the passageway. The seal member is supported across the passageway in a sealing position in a pre-activation condition of the valve. The seal member is movable from the sealing position to a fluid-flow position in an activated condition of the valve. The seal member includes a support body having a longitudinal axis, a seat, a leading surface facing in an upstream direction from the seat, and a trailing surface located in a downstream direction from the seat and contoured radially inwardly in the downstream direction. A Belleville washer is mounted on the seat of the support body.

19 Claims, 14 Drawing Sheets

(51) Int. Cl.
*A62C 35/62* (2006.01)
*A62C 37/42* (2006.01)
*A62C 37/11* (2006.01)

(58) Field of Classification Search
USPC ..... 169/4
See application file for complete search history.

(56) References Cited

U.S. PATENT DOCUMENTS

| | | | | |
|---|---|---|---|---|
| 2,506,468 | A | 5/1950 | Rider | |
| 2,865,225 | A | 12/1958 | Huffman | |
| 3,309,028 | A | 3/1967 | Zieg | |
| 3,392,787 | A | 7/1968 | Weise | |
| 3,419,083 | A | 12/1968 | Cholin et al. | |
| 3,463,235 | A | 8/1969 | Flajole | |
| 3,463,236 | A | 8/1969 | Flajole | |
| 3,616,860 | A | 11/1971 | Willms | |
| 3,657,942 | A | 4/1972 | Sullivan | |
| 3,684,023 | A | 8/1972 | Champagne | |
| 3,722,596 | A | 3/1973 | Livingston | |
| 3,734,191 | A | 5/1973 | Johnson et al. | |
| 3,768,567 | A | 10/1973 | Weise | |
| 3,779,318 | A | 12/1973 | Livingston | |
| 3,911,940 | A | 10/1975 | Johnson | |
| 3,924,687 | A | 12/1975 | Groos | |
| 3,991,829 | A | 11/1976 | Johnson | |
| 4,046,406 | A | 9/1977 | Press et al. | |
| 4,082,148 | A | 4/1978 | Willms | |
| 4,128,128 | A | 12/1978 | Mears | |
| 4,201,014 | A | 5/1980 | Hess | |
| 4,220,208 | A | 9/1980 | Jackson et al. | |
| 4,258,795 | A | 3/1981 | Hansen | |
| 4,368,782 | A | 1/1983 | Bray | |
| 4,553,602 | A | 11/1985 | Pieczykolan | |
| 4,854,388 | A | 8/1989 | Wyatt | |
| 4,951,755 | A | 8/1990 | Barnett et al. | |
| 4,976,320 | A | 12/1990 | Polan | |
| 5,127,479 | A | 7/1992 | Stehling et al. | |
| 5,188,184 | A | 2/1993 | Northill | |
| 5,295,503 | A | 3/1994 | Meyer et al. | |
| 5,396,959 | A | 3/1995 | Macdonald | |
| 5,415,239 | A | 5/1995 | Kotter et al. | |
| 5,533,576 | A | 7/1996 | Mears | |
| 5,609,211 | A | 3/1997 | Meyer et al. | |
| 5,669,449 | A | 9/1997 | Polan et al. | |
| 5,775,431 | A | 7/1998 | Ondracek | |
| 5,967,240 | A | 10/1999 | Ondracek | |
| 6,029,749 | A | 2/2000 | Reilly et al. | |
| 6,073,700 | A * | 6/2000 | Tsuji | A62C 37/16 169/90 |
| 6,158,519 | A | 12/2000 | Kretschmer | |
| 6,336,510 | B1 * | 1/2002 | Gadini | A62C 37/21 137/79 |
| 6,536,534 | B1 * | 3/2003 | Sundholm | A62C 35/68 169/37 |
| 6,666,277 | B2 | 12/2003 | Reilly | |
| 6,691,790 | B1 | 2/2004 | MacDonald, III et al. | |
| 6,851,482 | B2 | 2/2005 | Dolan | |
| 7,032,681 | B1 | 4/2006 | Sprakel | |
| 7,055,612 | B2 | 6/2006 | Jackson et al. | |
| 7,104,333 | B2 | 9/2006 | Ringer | |
| 7,143,834 | B2 | 12/2006 | Dolan | |
| 7,185,711 | B2 | 3/2007 | Jackson et al. | |
| 7,322,423 | B2 | 1/2008 | Ringer | |
| 7,353,881 | B2 | 4/2008 | Akins et al. | |
| 7,373,720 | B1 | 5/2008 | Jensen et al. | |
| 7,516,800 | B1 | 4/2009 | Silva, Jr. et al. | |
| 7,543,653 | B2 | 6/2009 | Reilly et al. | |
| 7,823,650 | B2 | 11/2010 | Eckholm et al. | |
| 7,921,928 | B2 | 4/2011 | Thompson et al. | |
| 8,083,002 | B1 | 12/2011 | Golinveaux et al. | |
| 8,528,653 | B1 | 9/2013 | Silva, Jr. et al. | |
| 8,584,767 | B2 | 11/2013 | Johnson et al. | |
| 8,746,358 | B2 | 6/2014 | Alchalel et al. | |
| 8,776,903 | B2 | 7/2014 | Jimenez et al. | |
| 8,800,673 | B2 | 8/2014 | Multer et al. | |
| 8,844,554 | B2 | 9/2014 | Kikuchi et al. | |
| 8,887,822 | B2 | 11/2014 | Polan | |
| 8,973,672 | B2 | 3/2015 | Fraederich | |
| 9,121,521 | B2 | 9/2015 | Girouard | |
| 9,339,673 | B2 | 5/2016 | Shipman | |
| 9,345,918 | B2 | 5/2016 | Bucher et al. | |
| 9,358,411 | B2 | 6/2016 | Shipman | |
| 9,395,918 | B2 | 7/2016 | Ho et al. | |
| 9,415,250 | B2 | 8/2016 | Bucher et al. | |
| 9,415,256 | B2 | 8/2016 | Inzer | |
| 9,901,763 | B2 | 2/2018 | Meyer et al. | |
| 10,646,736 | B2 | 5/2020 | Meyer et al. | |
| 10,653,908 | B2 | 5/2020 | Meyer et al. | |
| 2003/0075343 | A1 | 4/2003 | Ballard | |
| 2003/0132009 | A1 | 7/2003 | Thompson | |
| 2004/0123989 | A1 | 7/2004 | Sprakel et al. | |
| 2005/0121206 | A1 | 6/2005 | Dolan | |
| 2007/0000671 | A1 | 1/2007 | Reilly et al. | |
| 2007/0007020 | A1 | 1/2007 | Chase | |
| 2007/0221388 | A1 | 9/2007 | Johnson | |
| 2007/0267202 | A1 | 11/2007 | Mariller | |
| 2010/0038099 | A1 | 2/2010 | Thompson et al. | |
| 2011/0024138 | A1 | 2/2011 | Multer et al. | |
| 2011/0214888 | A1 | 9/2011 | Alchalel et al. | |
| 2012/0031630 | A1 | 2/2012 | Stephens | |
| 2012/0199764 | A1 | 8/2012 | Girouard | |
| 2012/0298383 | A1 | 11/2012 | Shipman | |
| 2013/0037281 | A1 | 2/2013 | Szentimrey et al. | |
| 2013/0199803 | A1 | 8/2013 | Multer | |
| 2013/0319696 | A1 | 12/2013 | Polan | |
| 2015/0060091 | A1 | 3/2015 | Polan | |
| 2015/0075821 | A1 | 3/2015 | Bucher et al. | |
| 2015/0121206 | A1 | 4/2015 | Odonoghue et al. | |
| 2017/0028238 | A1 | 2/2017 | Meyer et al. | |
| 2017/0340911 | A1 | 11/2017 | Meyer et al. | |
| 2018/0043198 | A1 | 2/2018 | Meyer et al. | |
| 2018/0361182 | A1 | 12/2018 | Meyer et al. | |

FOREIGN PATENT DOCUMENTS

| | | | |
|---|---|---|---|
| JP | S50083097 | U | 7/1975 |
| JP | S51117500 | U | 9/1976 |
| JP | 2000153005 | A | 6/2000 |
| JP | 2001340485 | A | 12/2001 |
| JP | 2003164543 | A | 6/2003 |
| KR | 101259098 | B1 | 5/2013 |
| WO | 2009108944 | A2 | 9/2009 |
| WO | 2017019904 | A1 | 2/2017 |
| WO | 2017075070 | A1 | 5/2017 |

OTHER PUBLICATIONS

Wilkins, "The Use of Specific Application Sprinklers for Protecting Attics", Tyco Fire & Building Products, pp. 1-92 (Oct. 21, 2007).
Examination Report dated Feb. 14, 2020 in Australian Application No. 2018286522.

* cited by examiner

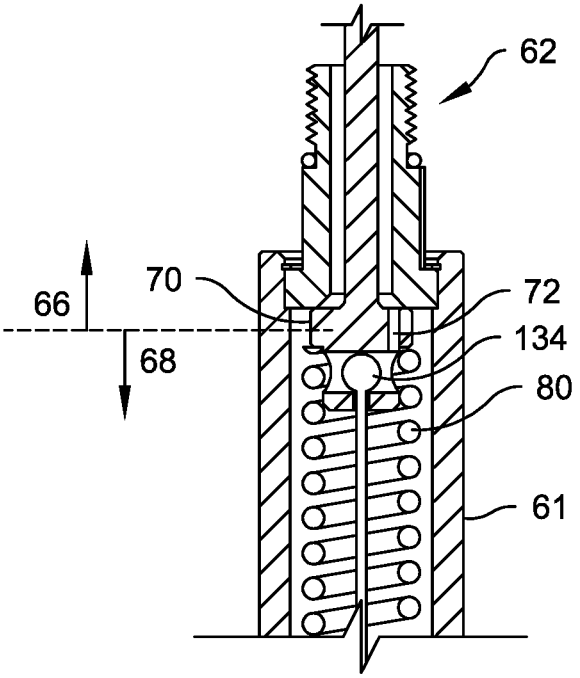
*Fig. 9*
*Fig. 10*
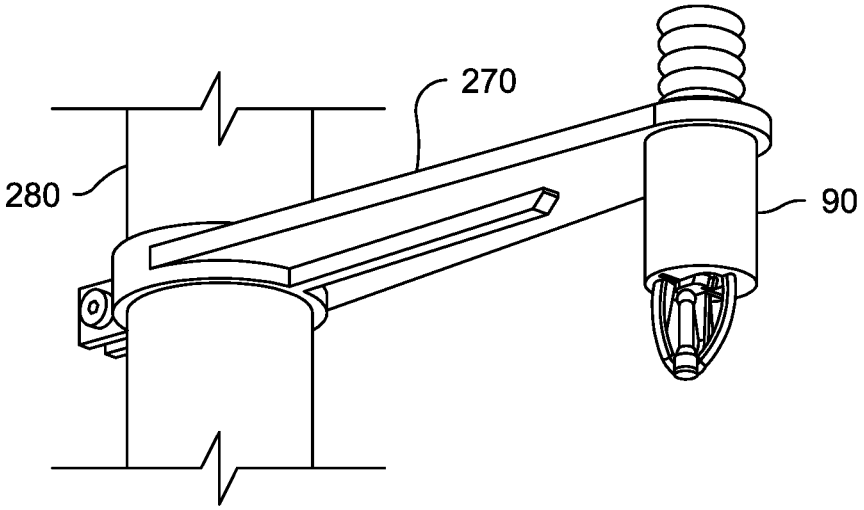

BELLEVILLE SEAL FOR VALVE SEAT HAVING A TEAR DROP LAMINAR FLOW FEATURE

CROSS-REFERENCE TO RELATED APPLICATIONS

This application claims the benefit of priority under 35 USC § 119(e) of U.S. Provisional Patent Application Nos. 62/782,788 filed Dec. 20, 2018 and 62/625,842 filed Feb. 2, 2018, and the contents of each application identified in this paragraph are incorporated into the present application by reference in their entirety.

BACKGROUND OF THE INVENTION

The present invention relates generally to fire protection and more particularly to valves and seal assemblies for use in fire-protection systems.

Fire sprinkler system installation and operation are subject to nationally recognized codes.

As is pointed out in U.S. Pat. App. Pub. No. 2013/0199803, dry sprinklers are used in areas that are or may be exposed to freezing conditions, such as in freezers, unheated internal areas, walkways, etc. In typical dry-pipe systems, supply conduits run in a space where the water in the supply conduit is not subject to freezing. A dry sprinkler, which is "dry" because it does not contain water until the sprinkler system has been triggered, is attached to the supply conduit and extends into a space where the water would otherwise be subject to freezing.

As U.S. Pat. App. Pub. No. 2013/0199803 further points out, the typical construction of a dry sprinkler comprises a tube ("drop") with a pipe connector at the inlet end of the tube (for connecting the inlet end to the supply pipe network of the fire suppression system), a seal member at the inlet end to prevent water from entering the tube prior to activation such as in the case of a fire, and a mechanism to maintain the seal at the inlet end until the sprinkler is activated. Typically, a nozzle with an outlet and a deflector is attached to the opposite, outlet end of the tube. Also, the tube is sometimes vented to the atmosphere to allow drainage of any condensation that may form in the tube. Such dry sprinklers are disclosed, for example, in U.S. Pat. No. 5,775,431. As shown generally in that patent, the actuating mechanism can include a rod or other similar rigid structure that extends through the tube between the nozzle end and the inlet end to maintain a seal at the inlet end. The actuating mechanism further may include a thermally responsive element that supports the rod or the like at the nozzle end and thereby supports the seal at the inlet end. Alternatively, the tube is also sealed at the nozzle end of the tube, and the rod is supported at the nozzle end by the seal member which is itself supported by the thermally responsive support element. In such arrangements, the space in the tube between the two seal members can be pressurized with a gas, such as dry air or nitrogen, or filled with a liquid such as an antifreeze solution. When an elevated temperature is experienced, the thermally responsive support element fails, thereby allowing the rod to move releasing the inlet end seal (and also any outlet seal at the nozzle end of the tube) to allow water from the supply conduit to flow into and through the tube to the nozzle.

Various fire-protection systems including thermal trigger assemblies for remote mechanical actuation of another fire-protection component, as described in the related applications listed herein, are known. Such fire-protection systems generally include one or more valves for controlling the flow of water or other fire-suppression liquid (collectively referenced as "water" herein). The present application discloses valves for use in such fire-protection systems or with a dry sprinkler as described above, or to be incorporated into a dry sprinkler. The present application also discloses a fire-protection system comprising such a valve or dry sprinkler.

BRIEF SUMMARY OF THE DISCLOSURE

Briefly stated, one aspect of the present disclosure is directed to a fire-protection system for delivering a fire-control fluid. The fire-protection system comprises a valve having a body with an inlet, an outlet, and a fluid passageway connecting the inlet with the outlet. A seal member is supportable across the passageway to close the passageway. The seal member is supported across the passageway in a sealing position in a pre-activation condition of the valve. The seal member is movable from the sealing position to a fluid-flow position in an activated condition of the valve. The seal member comprises a support body having a longitudinal axis, a seat, a leading surface facing in an upstream direction from the seat, and a trailing surface located in a downstream direction from the seat and contoured radially inwardly in the downstream direction. A Belleville washer is mounted on the seat of the support body.

Briefly stated, another aspect of the present disclosure is directed to a fire-protection system for delivering a fire-control fluid. The fire-protection system comprises a valve having a body with a fluid aperture having an aperture axis, and a fluid-flow axis parallel to a direction of flow of fluid through the fluid aperture. A seal member is supportable to close the fluid aperture. The seal member has a blocking position and orientation, and the seal member prevents a fluid flow through the aperture in a pre-activation condition of the fire-protection system when in the blocking position and orientation. The seal member is movable from the blocking position and orientation to a fluid-flow position and orientation in an activated condition of the fire-protection system. The seal member comprises a Belleville washer having a washer axis. The support body comprises a leading portion oriented in an upstream direction with respect to the fluid flow when the seal member is in the fluid-flow position and orientation, and a trailing portion oriented in a downstream direction with respect to the fluid flow when the seal member is in the fluid-flow position and orientation. A transverse surface supports the Belleville washer, with the washer axis aligned with the aperture axis in the blocking position and orientation, and with the washer axis at an angle to the fluid-flow axis when the seal member is in the fluid-flow position and orientation. The support body is streamlined with respect to the direction of fluid flow when the seal member is in the fluid-flow position and orientation.

BRIEF DESCRIPTION OF THE DRAWINGS

The following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 9 is an enlarged partial elevational cross-sectional view of an alternative embodiment of activation component of the device of FIG. 2, shown in the activated condition;

FIG. 10 is a partial side perspective view of a bracket and a portion of the activation component of FIG. 2 secured to a conduit in accordance with a preferred embodiment of the invention;

DETAILED DESCRIPTION OF THE INVENTION

Figure 1:
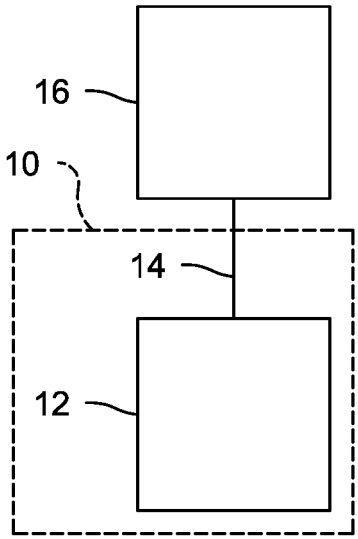
FIG. 1 is a schematic diagram of fire-protection system including a thermal trigger assembly configured for remote mechanical actuation of another fire-protection system component in accordance with a preferred embodiment of the invention.

Certain terminology is used in the following description for convenience only and is not limiting. The words "lower," "bottom," "upper," "top," "front," "back," and "rear" designate directions in the drawings to which reference is made. The words "inwardly" and "outwardly" refer to directions toward and away from, respectively, the geometric center of the component being discussed, and designated parts thereof, in accordance with the present disclosure. "Proximal" and "distal" refer to directions generally toward and away from, respectively, the fire-protection system component being triggered by the thermal trigger assembly or bulb, unless the context indicates otherwise. "Including" (and similar terms) should be read, as is customary, to mean "including but not limited to." "Upstream" refers to a direction from which fluid flows, and "downstream" refers to a direction to which fluid flows, in an activated condition. Unless specifically set forth herein, the terms "a," "an," and "the" are not limited to one element, but instead should be read as meaning "at least one." The terminology includes the words noted above, derivatives thereof, and words of similar import.

The valves and fire-protection devices (including dry sprinklers) disclosed herein may be used advantageously as part of systems including activation components and/or thermal trigger assemblies previously disclosed, including devices disclosed by the Applicant. For context, one such previously disclosed system is described, and the incorporation of a new valve into the previously disclosed system is described, before describing the new valves in detail. The preferred invention is also related to U.S. patent application Ser. No. 15/790,321 filed Oct. 23, 2017 (Pub. No. US 2018-0043198 A1); Ser. No. 15/648,861 filed Jul. 13, 2017 (Pub. No. US 2017-0340911 A1); Ser. No. 15/623,048 filed Jun. 14, 2017 (Pub. No. US 2018-0361182 A1); and Ser. No. 15/222,770 filed Jul. 28, 2016 (U.S. Pat. No. 9,901,763); the contents of each application identified in this paragraph are incorporated into the present application by reference in their entirety.

Referring to FIG. 1, in a block diagram of a preferred embodiment of the preferred disclosed fire-protection system, a thermal trigger assembly 10 is configured for remote mechanical actuation of another fire-protection system component 16, which in the preferred invention preferably is a valve as described below. The thermal trigger assembly 10 comprises an activation component 12 and a flexible connector 14 configured to allow the activation component 12 to remotely mechanically actuate the other fire-protection system component 16, which in some preferred embodiments (discussed below) is a valve, either of a new type presently disclosed herein, or as previously disclosed, for discharging water into one or more sprinklers. The other fire-protection system component 16 also may comprise a switch or a relay having a throw, a magnet (such as a Reed switch or relay), or an equivalent that can be mechanically moved, or another type of fire-protection system device actuatable by a mechanical input. As described in more detail below, the activation component 12 and the flexible connector 14 are not necessarily distributed in space in the same manner as they are depicted in the block diagram of FIG. 1.

In another preferred embodiment, as shown in FIGS. 2 through 8, a fire-protection system in the form of a dry sprinkler device includes a thermal trigger assembly configured for remote mechanical configuration of another fire-protection system component, which in FIGS. 2-4, 7, and 8 takes the form of a valve 20 according to the preferred invention. As noted above, the valve 20 may be controlled by any suitable trigger assembly, including the trigger assemblies disclosed in U.S. patent application Ser. No. 15/623,048, published as Pub. No. US 2018-0361182 A1 (as discussed herein), or the trigger assemblies discussed in any of the other U.S. patents or patent applications incorporated by reference in the present application.

Figure 5:
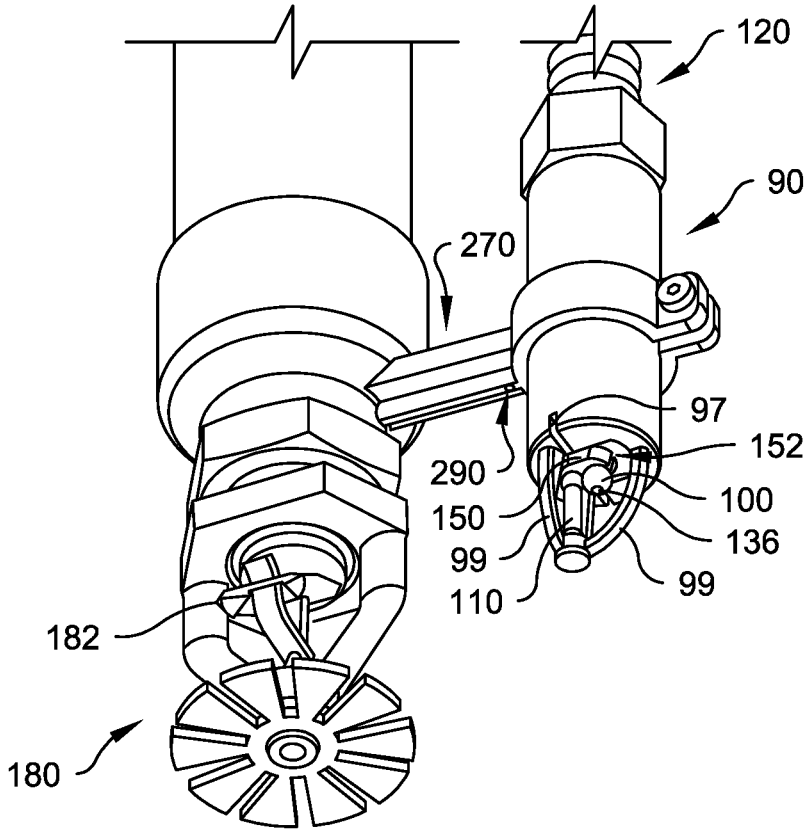
FIG. 5 is an enlarged partial bottom perspective view of the fire-protection system of FIG. 2, including the sprinkler head and a portion of the activation component.
Figure 6:
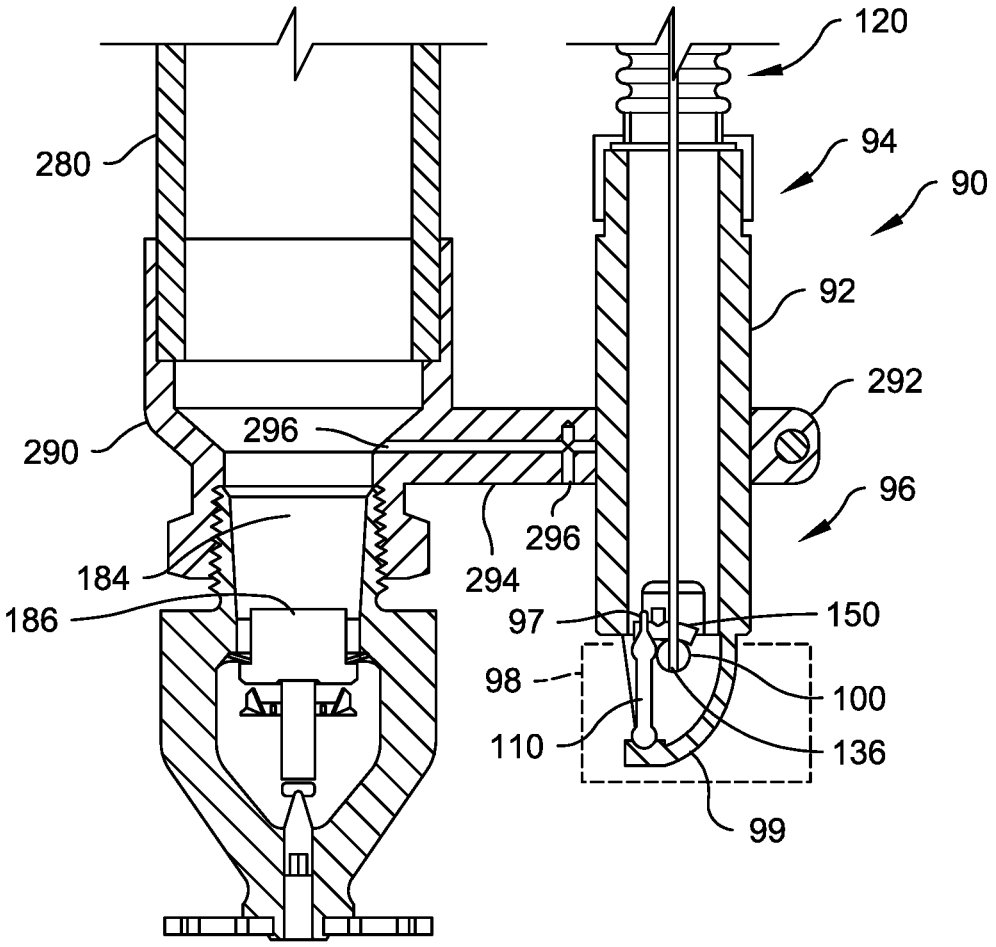
FIG. 6 is an enlarged partial elevational cross-sectional view of the components of FIG. 5.
Figure 7:
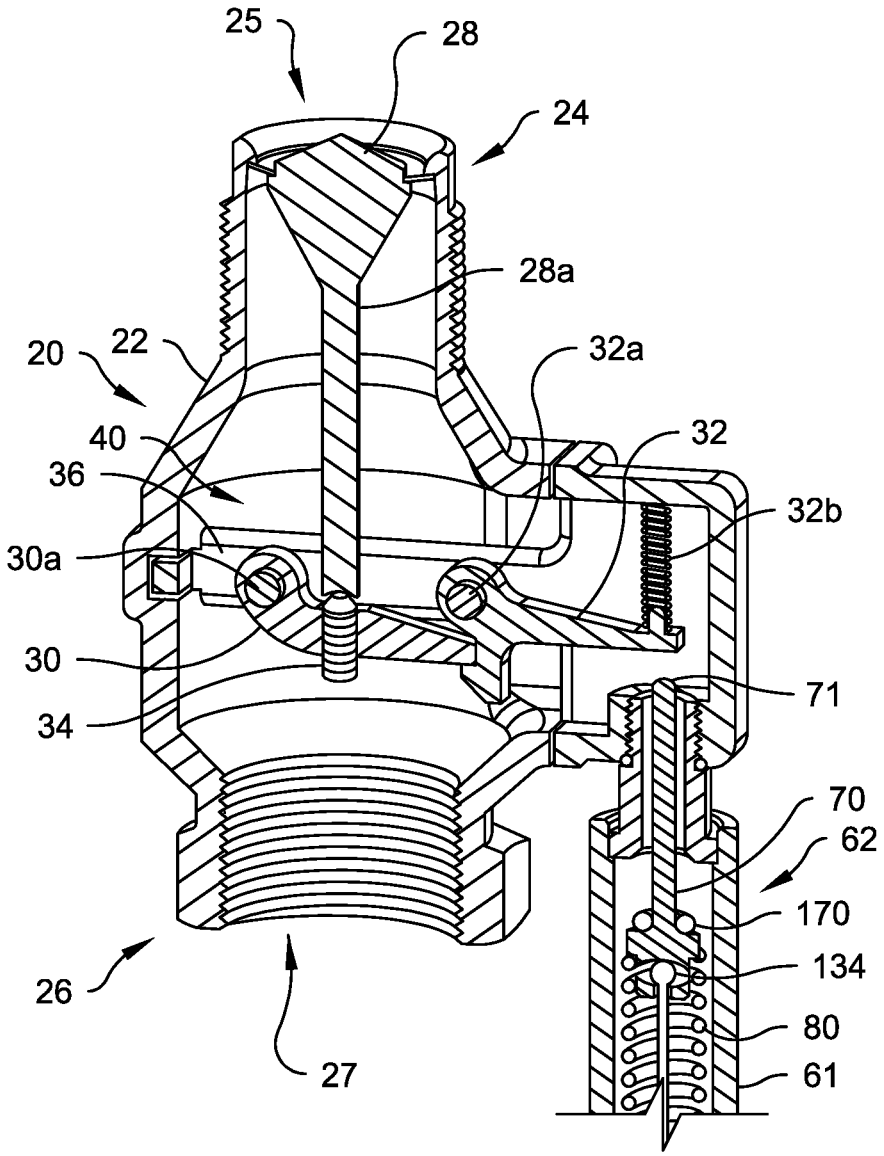
FIG. 7 is an enlarged partial side perspective cross-sectional view of the valve component and the activation component of FIG. 2, shown in the pre-activation condition and sealing position.
Figure 8:
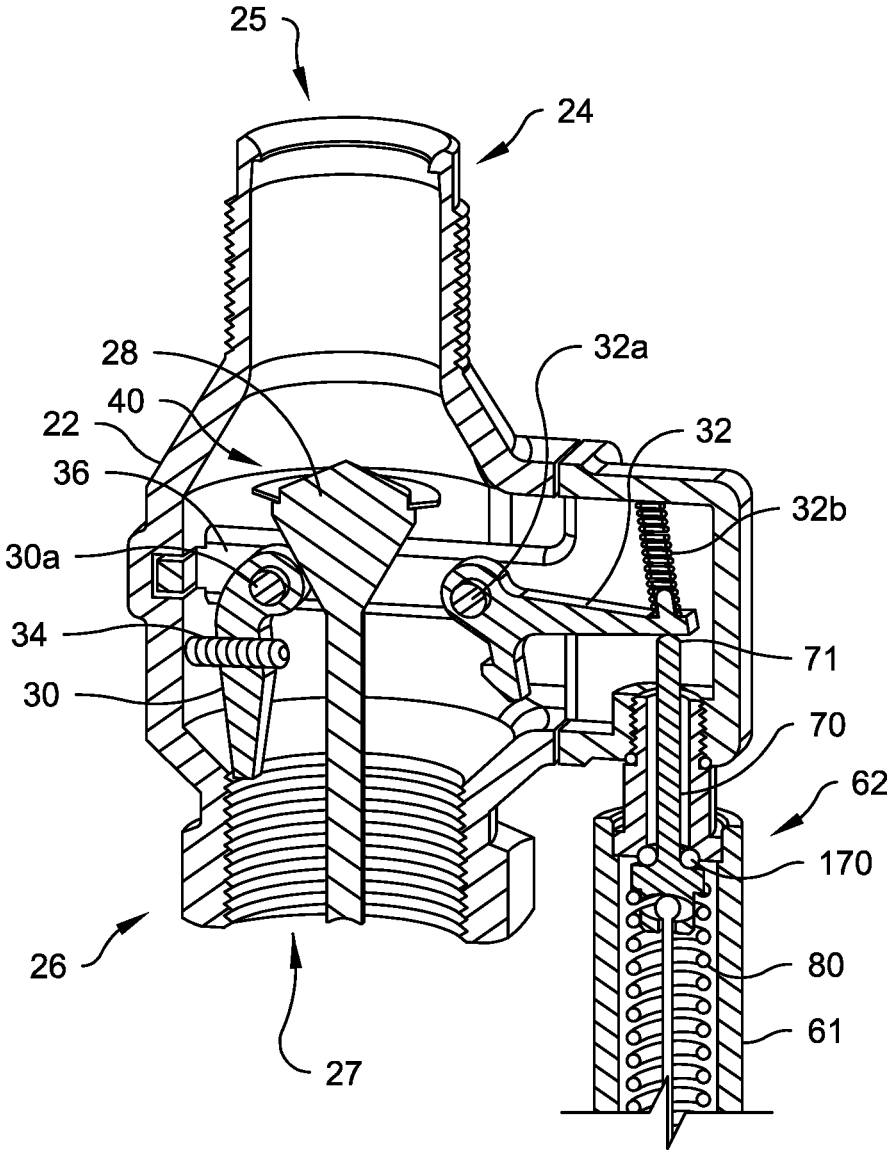
FIG. 8 is an enlarged partial side perspective cross-sectional view of the valve component and the proximal base of FIG. 7, shown in the activated condition.

In the preferred embodiment of FIGS. 2-8 and 12, the thermal trigger assembly comprises an activation component 50 including a proximal base 60 having a body 61, proximal end 62, and a distal end 64 with respect to the valve 20. In some embodiments, a nut 63 at the distal end 64 of the body 61 has a notched fitting 63*a* for attaching a flexible connector 120 (described below), and the nut engages the threads 64*a* on the body 61. A proximal movable member 70 is movable with respect to the proximal base 60. A bias member, best seen in FIGS. 7 and 8, is shown as a coil spring 80. A "bias member" as discussed herein could alternatively take the form of other devices capable of supplying a restorative force in response to a displacement—for example, an air spring or a leaf spring. The bias member (the coil spring 80) is located with respect to the proximal base 60 to bias the proximal movable member 70 from a pre-activation position, shown in FIG. 7, to an activated position, shown in FIG. 8, with respect to the proximal base 60.

The activated position is located proximally of the pre-activation position, so that a movement of the proximal movable member 70 from the pre-activation condition to the activated position with respect to the proximal base 60 is a movement generally proximally—that is, toward the other fire-protection component, the valve 20 (upwardly when viewing FIG. 8). Note that in the pre-activation position, shown in FIG. 7, there is a gap between the proximal end 71 of the proximal moveable member and the latch 32. In the activated position, shown in FIG. 8, the proximal end 71 of the proximal moveable member 70 is in contact with the latch 32. In some preferred embodiments, the proximal end 70*a* of the proximal moveable member 70 makes a forcible impact with a portion of the other fire protection component—for example, the latch 32 of the valve 20.

The thermal trigger assembly also comprises a distal base 90, a distal movable member in the form of a pull 100, and a thermally responsive element 110, which in some embodiments is an alcohol-filled glass bulb, is retained by the distal base 90 until a predetermined thermodynamic condition occurs or is reached. Alternatively, in certain embodiments the distal movable member could take the form of an end portion of the flexible connector 120.

The thermally responsive element 110 is configured to lose structural integrity under the predetermined thermodynamic condition and thereby allow the distal movable member 100 to move from a pre-activation position to an activated position located generally proximally (that is, toward the valve 20) with respect to the distal base 90. Referring to FIG. 6, the distal base 90 comprises a body 92 with a proximal end 94, a distal end 96, and an extension 98 (lying within the dashed box in FIG. 6) extending distally from the distal end 96, with the extension 98 including one or more arms 99 supporting the thermally responsive element 110. The distal base 90 also includes a fulcrum 97 supported by the distal base 90, which is also supported in the preferred embodiment by the extension 98.

Referring again to FIGS. 2-8, the thermal trigger assembly also comprises the flexible connector 120 having a proximal end 122 and a distal end 124, the proximal end 122 being connected to the proximal movable member 70, and the distal end 124 being connected to the distal movable member 100. The connections between the flexible connector 120 and other components may be direct or maybe indirect, with intervening connecting components disposed between the flexible connector 120 and, for example, the proximal movable member 70. The thermally responsive element 110 retaining the distal movable member, the pull 100, in the pre-activation position with respect to the distal base 90 also retains the proximal movable member 70 in the pre-activation position with respect to the proximal base 60. Upon the loss of structural integrity by the thermally responsive element 110, a biasing force from the bias member (the coil spring 80) causes a movement of the proximal movable member 70 from the pre-activation position of the proximal movable member 70 (FIG. 7) to the activated position of the proximal movable member 70 (FIG. 8).

The flexible connector 120 includes a flexible hollow outer cable housing 126 with a proximal housing end 128 configured to be stationarily connected with respect to the proximal base 60 and a distal housing end 130 configured to be stationarily connected with respect to the distal base 90. The flexible outer cable housing 126 may include at least one joint 126*a* joining two or more portions thereof. The flexible connector 120 also includes a flexible inner member 132 located inside the flexible hollow outer cable housing 126 for movement within the flexible outer cable housing 126 and having a proximal inner member end 134 (FIG. 7) and a distal inner member end 136 (FIG. 6), the proximal inner member end 134 being stationarily connected with the proximal movable member 70, and the distal inner member end 136 being stationarily connected with the distal movable member, which in the exemplary embodiment is the pull 100. The distal movable member may, as an alternative to the pull 100, include other bodies engaged with the flexible connector 120, the other bodies having any convenient shape. More generally, the proximal inner member end 134 is configured for a mechanical connection with the latch 32 for removing the support provided by the latch 32 from the seal member 28, thereby permitting a fluid to flow through the fluid passageway 40 of the valve 20.

Referring now to FIGS. 5 and 6, a platform 150 is engaged with the fulcrum 97, the distal movable member 100, and the thermally responsive element 110 such that the distal movable member 100 and the thermally responsive element 110 restrain the platform 150 on the fulcrum 97. Although the platform 150 is illustrated as a relatively flat plate, generally a platform 150 according to the preferred embodiment can take any shape that is supportable on the fulcrum 97 and that accommodates the necessary engagement of the thermally responsive element 110 and the distal movable member 100.

Upon the loss of structural integrity of the thermally responsive element 110 (due to the occurrence of a thermodynamic condition), the platform 150 pivots about the fulcrum 97 as a result of force from the bias member (the coil spring 80) transmitted by the flexible connector 120, allowing the distal movable member 100 to move to the activated position with respect to the distal base 90. In a preferred embodiment, as shown in FIGS. 5 and 6, the distal movable member 100 takes the form of a pull 100 attached to the distal inner member end 136 of the flexible connector 120, and the platform 150 has a notch 152 for engaging the pull 100.

Figure 4:
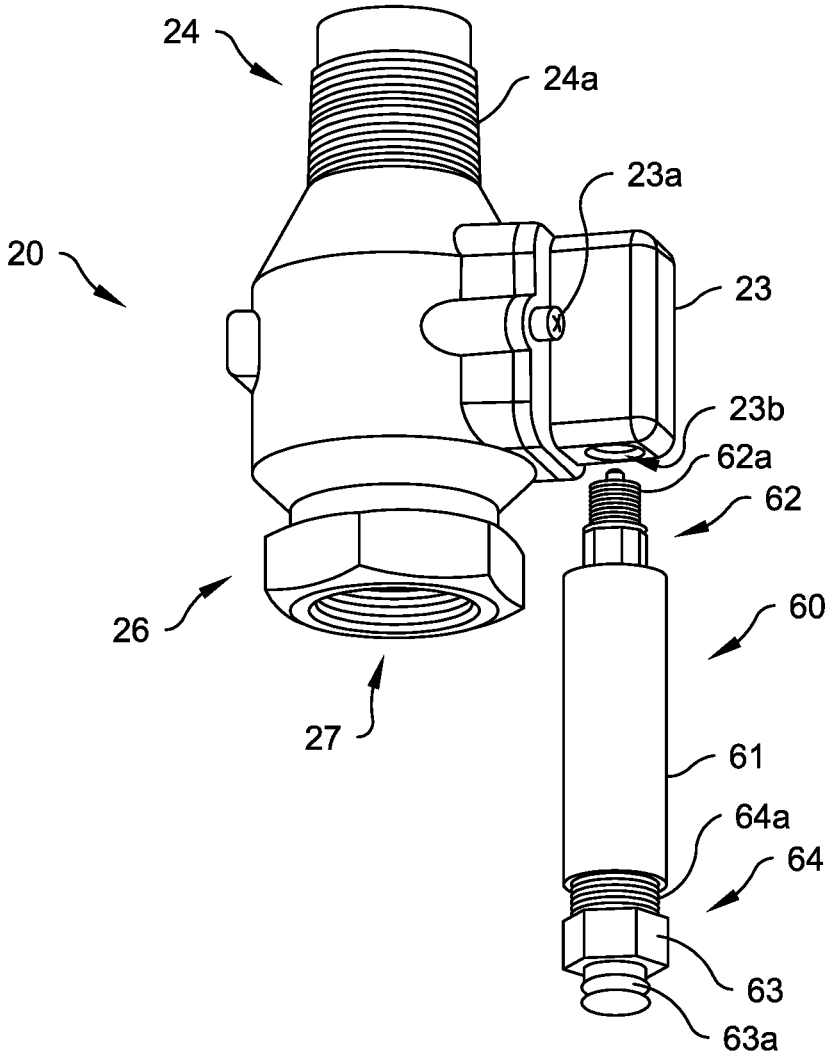
FIG. 4 is an enlarged and partially exploded side perspective view of fire-protection system of FIG. 2, including the valve component and a portion of the activation component.

In an exemplary embodiment, as shown in FIGS. 4, 7 and 8, the valve 20 of the present invention has a body 22 with an inlet 25 located at an inlet end 24, at least one outlet 27 located at an outlet end 26, and a fluid passageway 40 between the inlet 25 and the outlet 27. The inlet end 24 has screw threads 24*a* for attachment to a fluid source. The body 22 includes a removable cover 23 (FIG. 4) attached by screws 23*a* (one is shown). The removable cover 23 has a threaded opening 23*b* for attaching the proximal base 60 at the proximal end 62 via threads 62*a*. In an alternative embodiment, the valve 20 may have additional outlets (not shown) in fluid communication with the fluid passageway 40. A seal member 28, which is shown alone in FIG. 12 and is further described below, is supportable across the passageway 40 to close the passageway 40 by a lever 30, which is pivotally mounted by means of a lever pivot 30*a* located on a cross-member 36. The seal member 28 is supported across the passageway in a sealing position in a pre-activation condition of the valve 20. The seal member 28 is movable from the sealing position to a fluid-flow position in the activated condition of the valve 20.

The lever 30 is retained in a sealing position to hold the seal member 28 in place as shown in FIG. 7 to prevent fluid from flowing into and through the valve 20 through the inlet 25 by a latch 32 engaged with the lever 30. The movable member 70 is configured to engage the latch 32 for pivotal movement of the latch 32 counter-clockwise (as shown in FIGS. 7 and 8) about the pivot 32*a* with respect to the lever 30 by a movement of the proximal movable member 70 in the proximal direction in the activation position of FIG. 8. The latch 32 is supported by a latch pivot 32*a* located on the cross-member 36. A latch bias member, here a latch spring 32*b* acting in compression, retains the latch 32 in position supporting the lever 30 when in the pre-activation condition position of FIG. 7. Optionally an adjustment screw 34 (FIG. 8) threadedly engages the lever 30 and a shaft portion 28*a* of the seal member 28 to support the seal member 28, with the combination providing a mechanism to adjust the sealing engagement of the seal member 28 with the inlet 25. More generally, the proximal inner member end 134 (FIG. 7) of the flexible connector 120 is configured for engagement with the latch 32, either through direct contact or acting through intervening components (such as the proximal movable member 70), for removing the support provided by the latch 32 from the seal member 28 so that the seal member 28 moves (under pressure provided by the water) away from the inlet 25 of the valve 20, thereby permitting a fluid to flow through the fluid passageway 40 (see FIG. 8).

Figure 2:
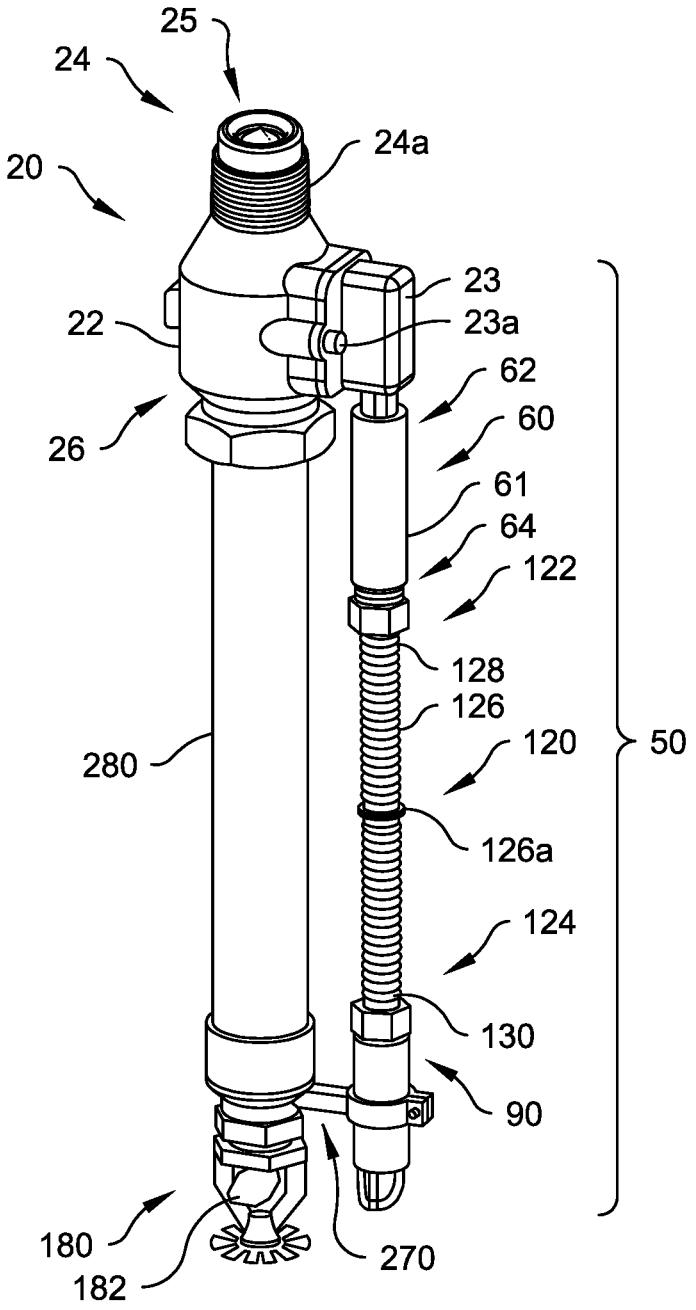
FIG. 2 is a side perspective view of a fire-protection system including a valve, an activation component, and a sprinkler head, in accordance with a preferred embodiment of the invention.
Figure 3:
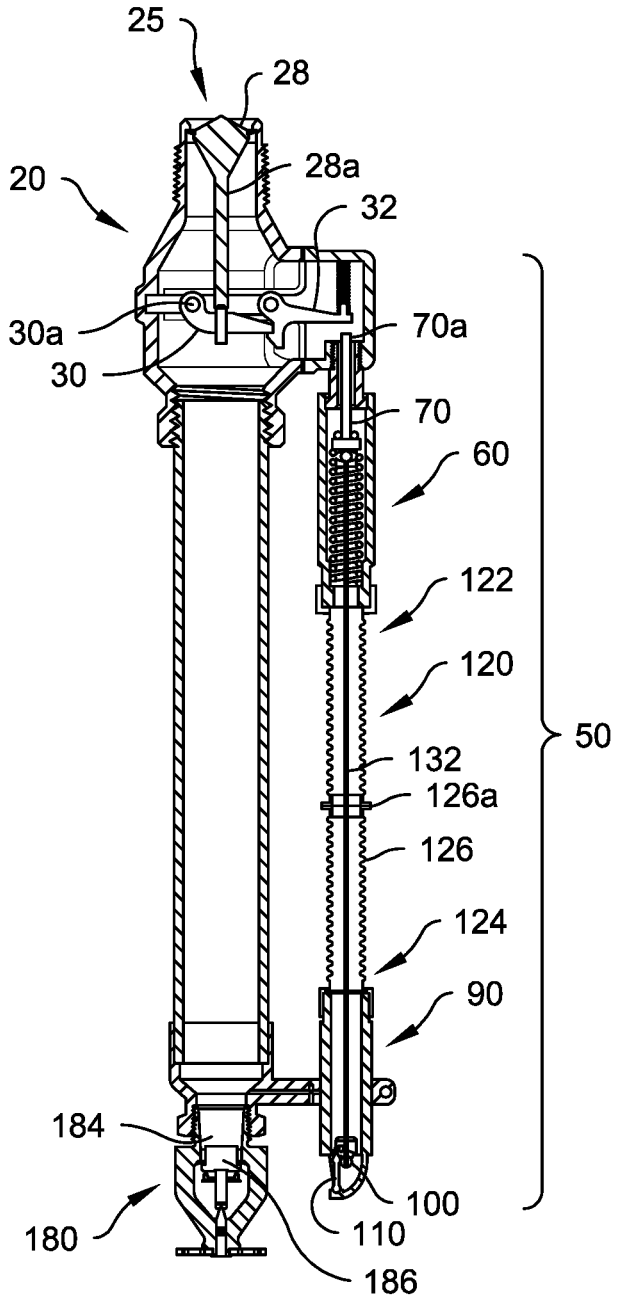
FIG. 3 is a cross-sectional view of the fire-protection system of FIG. 2.

Referring to FIGS. 3 and 8, the proximal movable member 70 in the activated position is sealingly engaged with the proximal base 60 by the seal 170. Alternatively, referring to FIG. 9, the seal 170 is omitted, and the proximal movable member 70 comprises a weephole 72 permitting fluid communication between a proximal portion 66 of the body 61 of the proximal base 60 with respect to the proximal movable member 70, and a distal portion 68 of the body 61 of the proximal base 60 with respect to the proximal movable member 70. Referring again to FIGS. 2-8, it is advantageous for the proximal movable member 70 to sealingly engage the proximal base 60 where the activation component 50 is used to control the valve 20 for permitting water flow to a sprinkler head 180, which remains closed until a second thermally responsive element 182 of the sprinkler head 180 (see FIG. 2) loses structural integrity under a predetermined thermodynamic condition. The sprinkler head 180 may include any of the wide variety of sprinkler heads currently common in the art, or any other type of water-discharge device for delivering water or other fluid onto a fire, and may include both open sprinkler heads and sprinkler heads containing plugs or other mechanisms for blocking and permitting fluid flow. This combination of components creates a system in which water flows through the sprinkler head 180 only if both the thermally responsive element 110 of the distal base 90 and the thermally responsive element, depicted as a fusible member 182, of the sprinkler head 180 are both activated. If the thermally responsive element 110 alone loses structural integrity, the valve 20 is opened, but water cannot flow through the sprinkler head 180; moreover, the sealing engagement of the proximal movable member 70 with the proximal base 60 prevents or minimizes water flow through the proximal base 60.

In the embodiment of FIG. 9, the weephole passage 72 of the proximal movable member 70 permits a small amount of water to flow through the proximal base 60 so that the triggering of the valve 20 alone, without the triggering of the sprinkler head 180, is more easily detected because water leaks through the weephole passage 72, eventually leaking from the activation component 50, with water becoming detectable in the vicinity of the distal base 90.

Referring to FIG. 10, a bracket 270 according to an exemplary embodiment of the invention supports the distal base 90 on a conduit 280.

Figure 11:
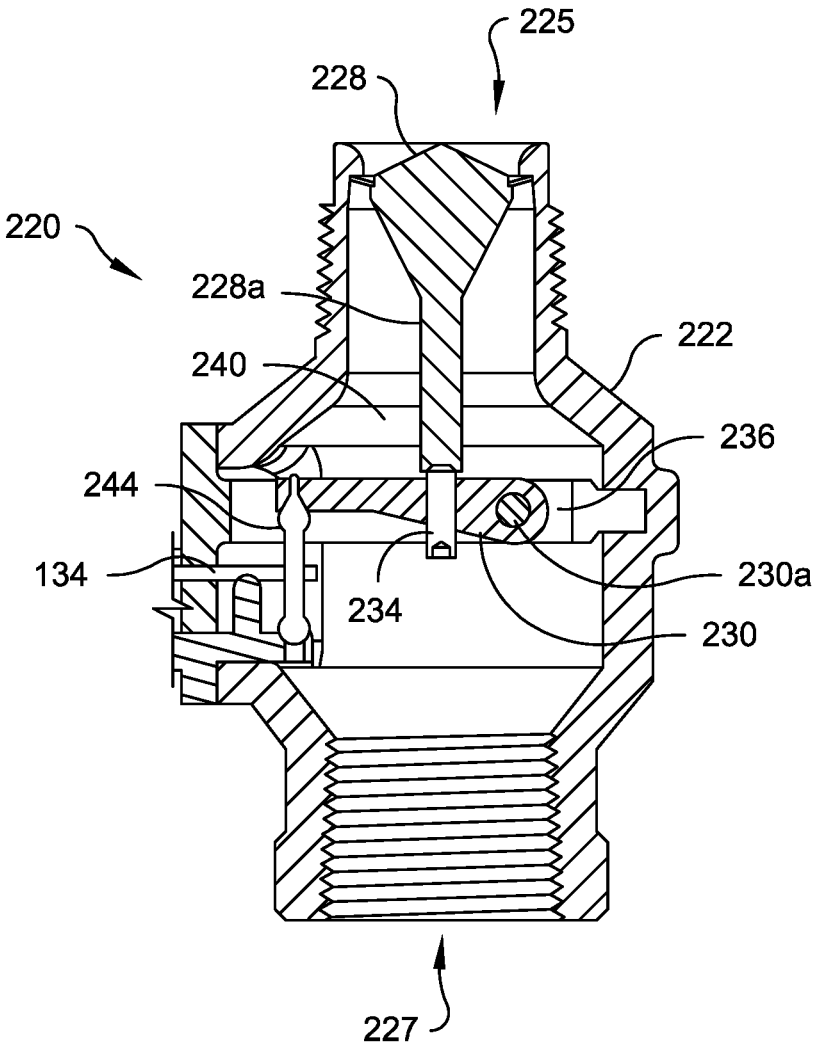
FIG. 11 an enlarged partial elevational cross-sectional view of a valve component in accordance with a preferred embodiment of the invention, shown in the pre-activation condition and sealing position.

In an alternative embodiment, shown in FIG. 11, the other fire component 20 referenced in the discussion of FIG. 1 may take the form of a valve 220, which is similar in many respects to the valve 20 of the above-described preferred embodiment. The valve 220 has a body 222 with an inlet 225, an outlet 227, and a fluid passageway 240 between the inlet 225 and the outlet 227. In the alternative embodiment, the valve 220 may have additional outlets (not shown) in fluid communication with the fluid passageway 240. A seal member 228 is supported across the passageway 240 to close the passageway 240 by a pivotally mounted lever 230, wherein the lever 230 is retained in a sealing position by a frangible support in the form of a glass bulb 244 engaged with the lever 230 until a movement of the flexible connector, the proximal inner member end 134 of the flexible connector being shown in FIG. 11, causes a collapse of the glass bulb 244. In the preferred embodiment shown, the proximal inner member end 134 causes the collapse by transmitting a force to break the glass bulb 244, and the proximal movable member takes the form of the proximal inner member end 134 of the flexible connector. The lever 230 is pivotally supported on the cross-member 236 by a lever pivot 230*a* located on a cross-member 236. Optionally an adjustment screw 234 threadedly engages the lever 230 and a shaft portion 228*a* of the seal member 228, which in turn supports the seal member 228, with the combination providing a mechanism to adjust the engagement of the seal member 228 with the inlet 225 for providing a tight seal. More generally, the proximal inner member end 134 of the flexible connector 120 is configured for engagement, either through direct contact or with intervening components, with the glass bulb 244 or other frangible support for removing the support from the seal member 228, thereby permitting water to flow through the passageway 240.

In another alternative preferred embodiment (not shown), the flexible inner member 132 may be run, with or without a flexible outer cable housing 126 similar to the above-described preferred embodiment, through the conduit 280 rather than outside of the conduit as shown in FIGS. 2-8, with the distal base 90 in the alternative embodiment located in or near the location occupied by the sprinkler head 180 in FIGS. 2, 3, and 5. A similar device is disclosed in U.S. Provisional Patent Application No. 62/782,788 filed Dec. 20, 2018, which is incorporated herein by reference as noted above.

Figure 12:
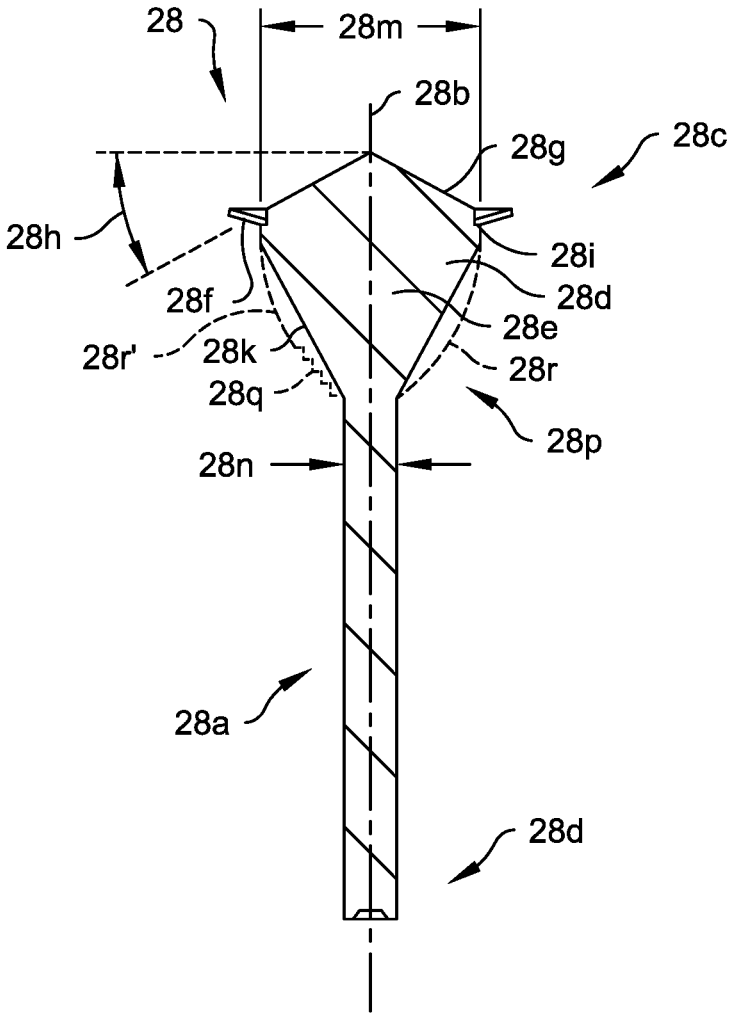
FIG. 12 is an enlarged elevational cross-sectional view of a seal member of the valve component of FIG. 4.

Referring to FIGS. 2-8 and 12, the valve 20 of the embodiment of FIGS. 2-8 and 12 includes the seal member 28, the details of which are best viewed in FIG. 12. As previously mentioned, the seal member 28 is supportable across the passageway 40 to close the passageway 40. The seal member 28 is supported across the passageway 40 in a sealing position in a pre-activation condition (FIG. 7) of the valve 20, wherein the seal member is movable from the sealing position to a fluid-flow position in an activated condition of the valve (compare FIGS. 7 and 8). The seal member 28 comprises a support body 28*e* having a longitudinal axis 28*b* and a shaft 28*a* generally parallel to the longitudinal axis 28*b*. The seal member 28 also comprises an upstream portion 28*c* and a downstream portion 28*d*. The seal member 28 preferably further comprises a flexible seal body, here a Belleville washer 28*f*, mounted to the support body 28*e* on a seat 28*i*. The Belleville washer 28*f* is preferably formed from an alloy of nickel, preferably with a Teflon or comparable coating. The remainder of the seal member 28 is preferably formed from metal, typically brass. A leading surface 28*g* of the support body 28*e* faces in an upstream direction from the seat 28*i*, and a trailing surface 28*k* is located in a downstream direction from the seat 28*i* and extends generally transversely to the longitudinal axis 28*b*.

The leading surface 28*g* may be sloped to form a leading-surface angle 28*h*, preferably of about forty-five to eighty-five degrees with the longitudinal axis 28*b*. In certain preferred embodiments, the centermost portion of the profile, as shown nearest the longitudinal axis 28*b*, may be flat or perpendicular to the longitudinal axis 28*b*, with the outer portion of the profile being sloped as shown. The leading surface 28*g* may include other contours, such as stepped or curved contours or combinations of contours. The trailing surface 28*k* is preferably tapered from a first diameter 28*m* to a smaller second diameter 28*n* at or near the upper portion 28*p* of the shaft portion 28*a*. The trailing surface 28*k* is preferably contoured radially inwardly in the downstream direction and may be sloped in a downstream direction about five to forty-five degrees from perpendicular to the longitudinal axis 28*b*. The trailing surface 28*k* shown in FIG. 12 is a preferably straight taper forming a frustoconical trailing portion or surface 28*k*; alternatively, the trailing surface 28*k* may include a multiple stepped trailing portion 28*q* (shown in phantom in FIG. 12), a curved trailing portion such as a parabolic or a parabola-like curved trailing portion 28*r* or 28*r'* (shown in phantom in FIG. 12). Note that the trailing surface 28*k* may include a combination of the multiply stepped trailing portion 28*q* and another profile—for example, a parabolic or parabola-like portion such as 28*r*.

With either a frustoconical or other contoured taper, the support body 28*e* has a streamlined teardrop shape to promote water flow. The streamlined shape of the support body 28*e* may promote laminar water flow through the passageway 40 (FIG. 7-8).

Referring again to FIGS. 2-8, the dry sprinkler device according to a preferred embodiment of the invention further comprises a conduit 280 in fluid communication with one of the at least one outlet 27 of the valve 20. The dry sprinkler device further comprises a water distribution device in the form of the sprinkler head 180 in fluid communication with the conduit 280, wherein the sprinkler head 180 comprises an inlet 184 and an outlet sealed with an outlet plug 186 retained in a sealing position by a second thermally responsive element, which in the illustrated embodiment is a fusible member 182, but which may take the form of an alcohol-filled bulb, or any suitable form of thermally responsive element. The second thermally responsive element is configured to lose structural integrity under the occurrence of the predetermined thermodynamic condition and thereby allow a fluid to flow from the inlet 184 and through the outlet of the sprinkler head 180. Note that the predetermined thermodynamic condition selected for failure of the second thermally responsive element may be, but need not be, a different predetermined thermodynamic condition from the condition selected for the thermally responsive element 110 of the distal base 90.

Referring to FIG. 6, in a presently preferred embodiment, a dry sprinkler device comprises a reducer 290 and a bracket 292 having an outer surface 294, wherein the bracket 292 is attached to the reducer 290. The attachment of the bracket 292 to the reducer 290 may optionally include the formation of the bracket 290 integrally with the reducer 290. In a preferred embodiment a weephole passage 296 is located proximally of the sealing member (the outlet plug 186) of the sprinkler head 180, wherein the weephole passage 296 being in fluid communication with the conduit 280 and the outer surface 294 of the bracket 292, which outer surface 294 is a portion of the outer surface of the dry sprinkler device. Referring to FIGS. 2-8, the weephole passage 296 of the bracket 290 permits a small amount of water to flow through the bracket 290 so that the triggering of the valve 20 alone, without the triggering of the sprinkler head 180, is more easily detected because water leaks through the weephole passage 296 onto the outer surface 294 of the bracket 292.

Figure 13:
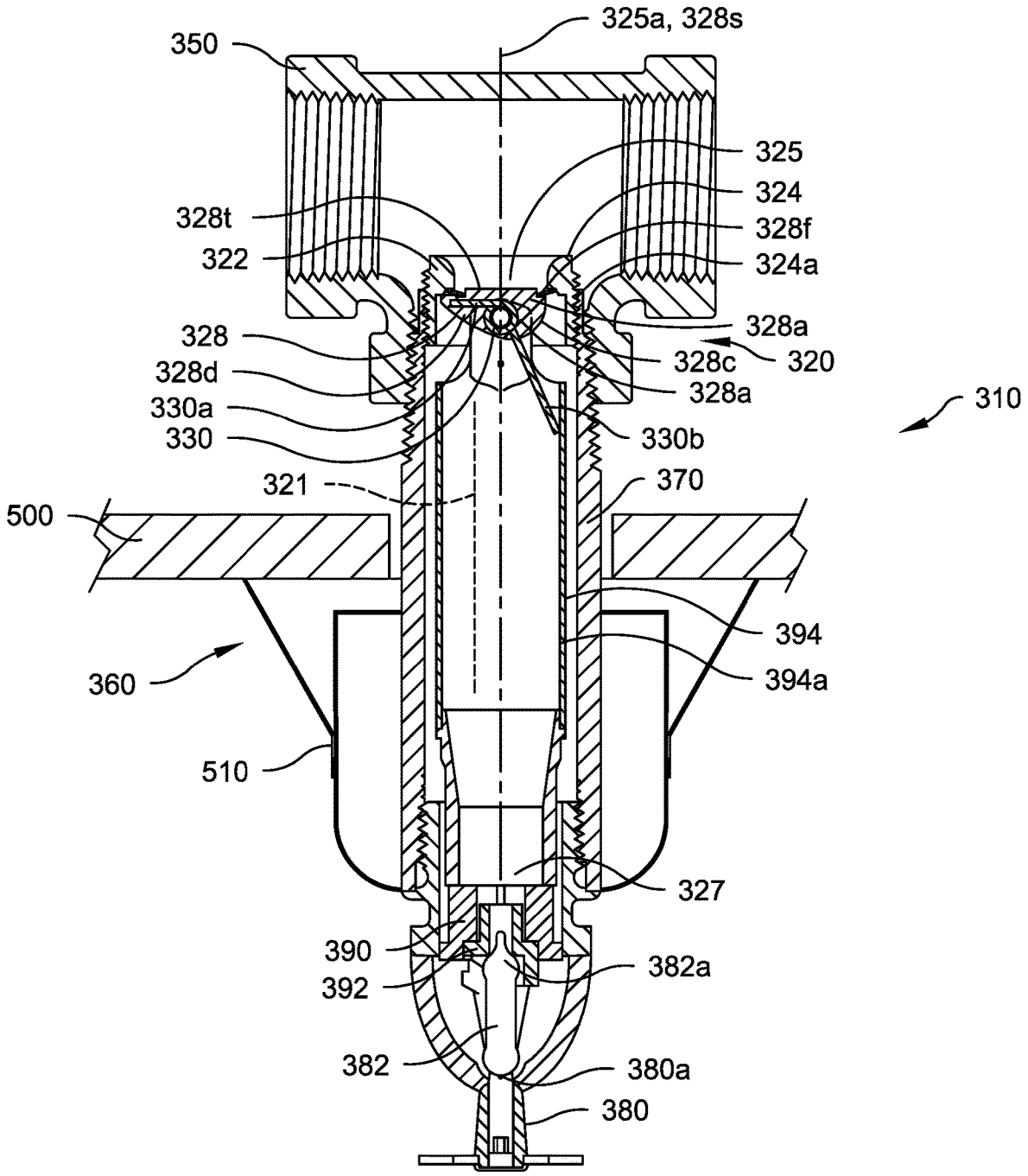
FIG. 13 is an enlarged elevational cross-sectional view of a dry sprinkler according to another preferred embodiment of the invention, mounted through a portion of a structure, shown in a pre-activation condition.
Figure 14:
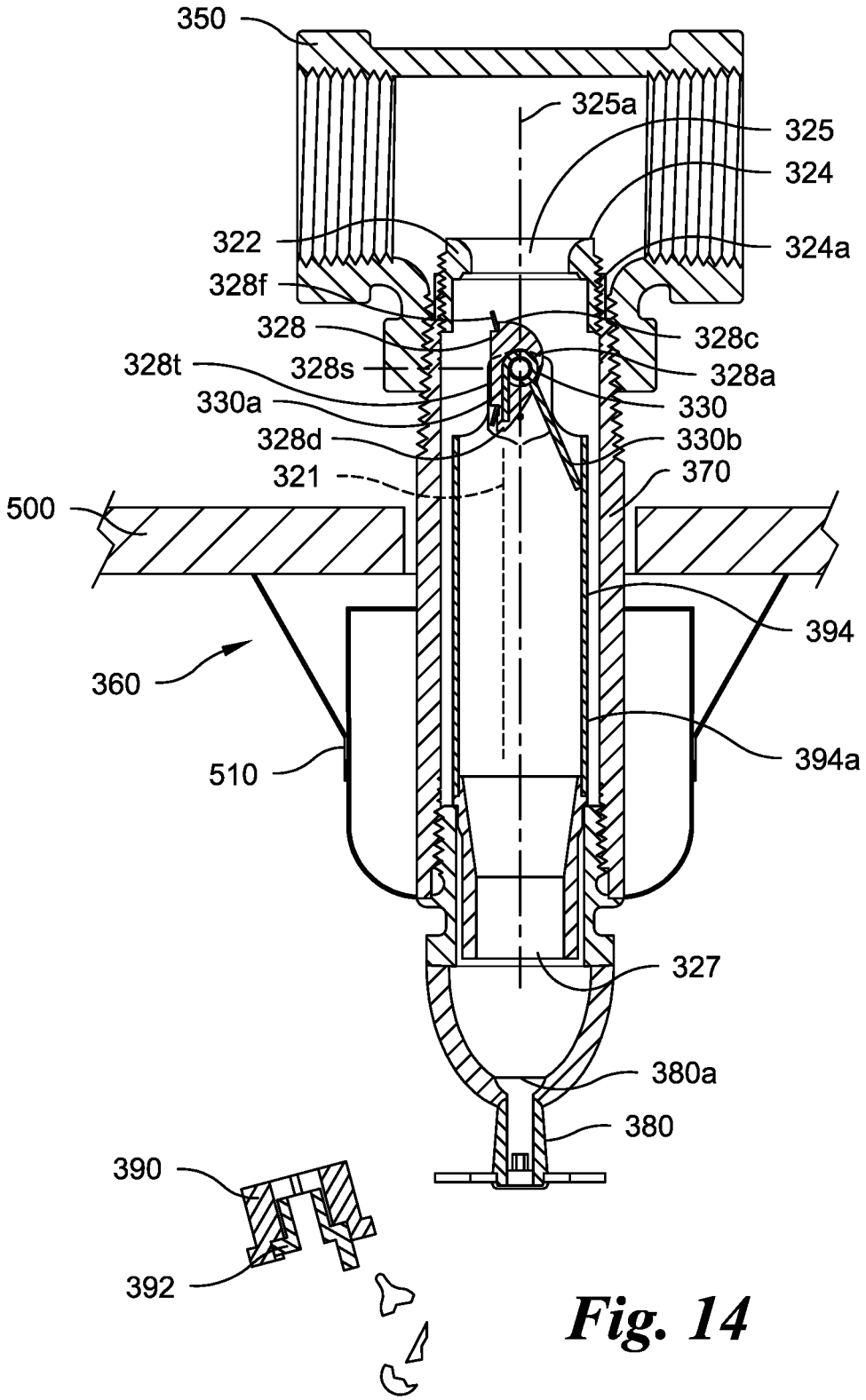
FIG. 14 is an enlarged elevational cross-sectional view of the embodiment of FIG. 13, shown in an activated condition.
Figure 15:
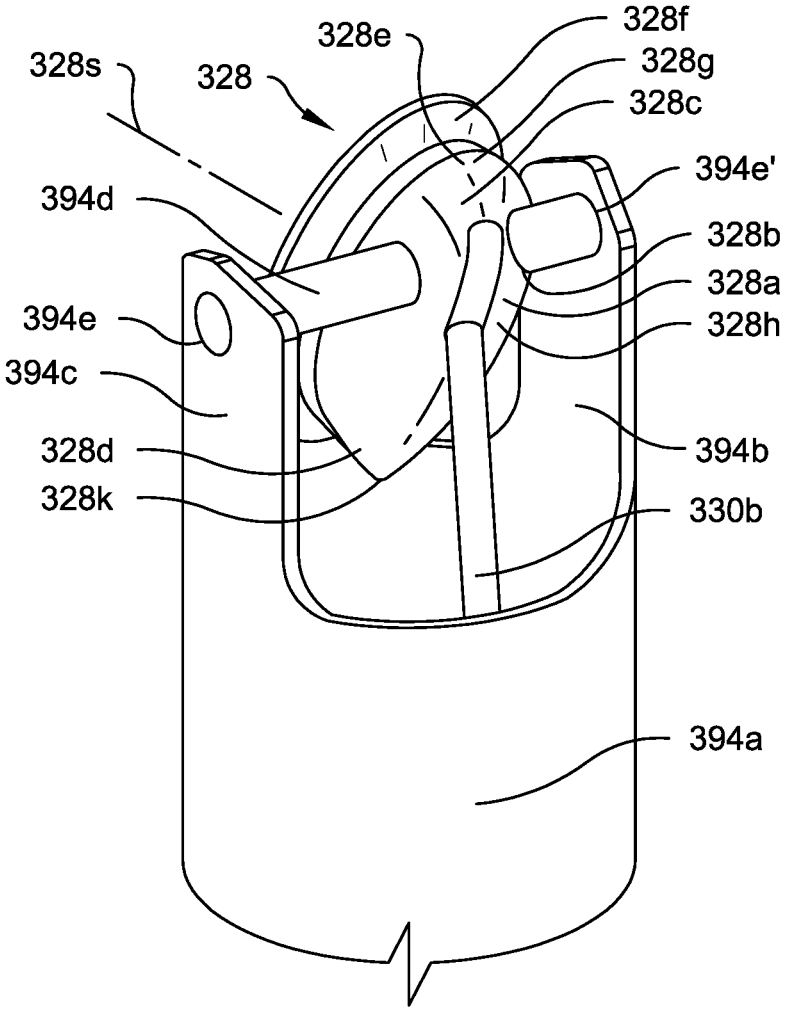
FIG. 15 is an enlarged partial side perspective view of the embodiment of FIG. 13, shown in an orientation consistent with the activated condition.

Referring to FIGS. 13-15, another embodiment of a fire-protection system for delivering a fire-control fluid comprises a valve 320 having a body 322 with a fluid aperture 325 having an aperture axis 325*a* and a fluid-flow axis 321 generally parallel to a direction of flow of fluid through the fluid aperture 325; here the fluid-flow axis "parallel to" the direction of flow of fluid encompasses an axis generally in the direction of flow of fluid, including in the same direction as the flow of fluid. An inlet end 324 of the valve 320 has threads 324*a* for connecting the valve 320 to piping 350. A seal member 328 is supportable to close the fluid aperture 325. The seal member 328 has a blocking position and orientation, as shown in FIG. 13, in which the seal member 328 prevents a fluid flow through the aperture 325 in a pre-activation condition of the fire-protection system. The seal member 328 is movable from the blocking position and orientation shown in FIG. 13 to a fluid-flow position and orientation, as shown in FIG. 14 in an activated condition of the fire-protection system. The movement from the blocking position and orientation shown in FIG. 13 to the fluid-flow position and orientation shown in FIG. 14 preferably occurs through an axial movement of the seal member 328 in combination with a rotation of a support body 328*a*, as described further below. When the seal member 328 moves downstream from the sealing position and orientation of FIG. 13 to a fluid-flow position, a clearance is created between a support body 328*a* and the aperture 325; the clearance provides a support body 328*a* space in which to rotate to the fluid-flow orientation, as illustrated in FIGS. 14 and 15.

In the preferred embodiment shown in FIGS. 13-15, the valve 320 is integrated into a sprinkler 360 including the valve 320, a conduit 370 in fluid communication with the valve 320 and having an outlet 327, and a sprinkler head 380. The sprinkler 360 is shown in FIGS. 13 and 14 mounted through a ceiling 500 and supported in part by an optional frame 510. In the pre-activation condition (FIG. 13), the sprinkler head 380 includes a thermally responsive element, which in the illustrated embodiment is an alcohol-filled glass bulb 382 supported on curved bulb platform 380*a*. The thermally responsive element, which may be the bulb 382 but may also take the form of a fusible link or other suitable element known in the art, is configured to lose structural integrity under the occurrence of a predetermined thermodynamic condition. A portion of the thermally responsive element, in this example an upper end 382*a* of the bulb 382, supports a plug 390, with an inner sleeve 392 therein, in the outlet 327.

The plug 390 and inner sleeve 392*a* preferably may not form a water-tight seal in the outlet 327 under the pre-activation condition shown in FIG. 13. In the absence of a water-tight seal in the outlet 327, when the valve 320 is triggered or fails and begins to allow water or other fluid to flow through the aperture 325 toward the sprinkler head 380 without the sprinkler head 380 itself being triggered through fracture of the bulb 382, the leakage of water through the plug 390 and/or the sleeve 392 gives an indication, on the exterior of the sprinkler 360, that fluid is passing through the valve 320. The plug 390 supports a longitudinal base in the form of a tubular base 394, which has a lower tubular portion 394*a* and an upper supporting portion including first and second upper arms 394*b* and 394*c*. Referring to FIG. 13, a transverse support member in the form of a support pin 394*d* extends transversely to the longitudinal base—in the present embodiment, across the tubular base 394 between the first and second upper arms 394*b*, 394*c*. The transverse support member may be secured in any suitable manner—for example, where the transverse support member is the support pin 394*d*, through an interference fit between the support pin 394*d* and two axially aligned mounting holes 394*e*, 394*e*' in the first and second upper arms 394*b*, 394*c*. The longitudinal member in the form of the tubular base 394 extends upstream from the plug 390, such that in the pre-activation condition, the seal member 328 may be aligned in the blocking position and orientation, as shown in FIG. 13, to close the fluid aperture 325 and prevent a fluid flow through the aperture 325.

Referring to FIGS. 14 and 15, in the activated condition, the predetermined thermodynamic condition has been reached, and the bulb 382 has fractured, removing the support from the plug 390 and the inner sleeve 392, which as a result have fallen from the inlet 327. As a result, the support for the tubular base 394 has been removed, and the tubular base 394 has moved axially downstream, thus moving the upper arms 394*b*, 394*c*, the support pin 394*d*, and ultimately the seal member 328 downstream from the sealing position to the fluid-flow position; this movement in turn allows clearance for the support body 328*a* to pivot into the fluid-flow position.

Referring again to FIGS. 13-15, the seal member 328 is pivotably mounted via a body-mounting hole 328*b* upon the support pin 394*d*, and a biasing member is preferably configured for rotating the support body 328*a* to rotate the support body to the fluid-flow position—that is, to orient a leading portion 328*c* of the support body 328*a* in the upstream direction with respect to the fluid flow and the trailing portion 328*d* in the downstream direction with respect to fluid flow. As shown in FIGS. 14 and 15, the support body 328*a* does not necessarily reach the theoretically perfect orientation; instead, the support body 328*a* preferably may rotate to align sufficiently with the fluid flow in the conduit 370 to reduce turbulence in the flow and provide greater flow through the sprinkler head 380. The biasing member may take the form of a torsion spring 330 as shown in FIGS. 13-15 or alternatively may include a coil spring, an air spring, an elastic member, or other devices known in the art to be capable to providing any needed biasing force. The torsion spring 330 has a first leg 330*a* (shown in phantom in FIGS. 13 and 14) engaging an interior portion (not shown) of the support body 328*a* and a second leg 330*b* extending from the support body 328*a* and engaging the tubular base 394 to provide a biasing force and/or torque between the support body 328*a* and the tubular base 394. The torsion spring 330 may not be needed if the location of the body-mounting hole 328*b* is such that the fluid flow itself stabilizes the support body 328*a* in the desired orientation.

Referring again to FIGS. 13-15, the seal member 328 comprises a Belleville washer 328*f* having a washer axis 328*s*. The seal member 328 further comprises the support body 328*a* supporting the Belleville washer 328*f*. The support body 328*a* has a leading portion 328*c* oriented in an upstream direction with respect to the fluid flow when the seal member 328 is in the fluid-flow position and orientation. A trailing portion 328*d* is oriented in a downstream direction with respect to the fluid flow when the seal member 328 is in the fluid-flow position and orientation; this generally may occur where the body-mounting hole 328*b* is relatively close (compared to the length of the support body 328*a*) to the leading point 328*e*—for example, within about the first fifty percent (50%), and preferably within the first twenty-five percent (25%), of the length of the support body as measured parallel to the fluid-flow axis when the support body 328*a* is in the fluid-flow orientation, as shown in FIG. 14. A transverse surface 328*t* supports the Belleville washer 328*f*. Note that in the preferred embodiment shown in FIGS. 13-15, the support body 328*a* is not circumferentially uniform, with the transverse surface 328*t* flatter or having a greater radius of curvature than, for example, the opposite surface of the support body 328*a*. The transverse surface 328*t* is oriented so that the washer axis 328*s* is aligned with the aperture axis 325*a* in the blocking position and orientation, as shown in FIG. 13, where aperture axis 325*a* and the washer axis 328*s* are substantially coaxial. The transverse surface 328*t* is preferably aligned so that the washer axis 328*s* is aligned at an angle to the fluid-flow axis 321, and preferably an angle greater than 60 degrees, when the seal member 328 is in the fluid-flow position and orientation. The support body 328*a* is streamlined with respect to the direction of fluid flow when the seal member 328 is in the fluid-flow position and orientation. In some embodiments, and as shown in FIG. 14, when the leading portion 328*c* is oriented upstream with respect to the fluid flow, a forward surface 328*g* of the support body 328*a* is contoured radially outwardly in the downstream direction from a leading point 328*e* to a point of maximum cross-section of the support body 328*a*, and a rearward surface of the support body 328*a* is contoured radially inwardly from the point of maximum cross-section 328*h* to a trailing point 328*k* of the support body 328*a*.

Returning to FIGS. 2-8, in certain preferred embodiments of the present invention, movement of the proximal movable member 70 is caused by the bias member (the coil spring 80), which is located at the proximal end 122 of the flexible connector 120, near the valve 20 or another fire system component 16. This may result in more reliable operation than a configuration in which a bias member is located at the distal end 124 of the flexible connector 120 and must overcome any deformation of the flexible connector 120 in order to generate sufficient movement to actuate the valve 20 or other fire system component 16.

The ability to displace the activation component of fusible member 82 from the sprinkler head 180 or other device being controlled permits the advantageous location of the activation component of fusible member at an optimal location for fire identification and response, and permits placement of the connected sprinkler(s) at optimal location(s) for water distribution and/or coverage.

Another possible use of the preferred devices of the present invention is the provision of fire-protection in attics of wood construction and other combustible concealed areas without or with obstructions.

Since in certain preferred embodiments the valve components of the present invention can be mechanically tripped, they can be further configured or accessorized to be separately remotely tripped, automatically or on demand.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

We claim:

1. A fire-protection system for delivering a fire-control fluid, the fire-protection system comprising:

a valve having a body with a fluid aperture having an aperture axis, and a fluid-flow axis parallel to a direction of flow of fluid through the fluid aperture;

a seal member supportable to close the fluid aperture, the seal member having a blocking position and orientation, the seal member preventing a fluid flow through the aperture in a pre-activation condition of the fire-protection system when in the blocking position and orientation, the seal member being movable from the blocking position and orientation to a fluid-flow position and orientation in an activated condition of the fire-protection system, the seal member comprising:

a Belleville washer having an aperture and a washer axis passing through the center of the aperture, perpendicular to the Belleville washer; and a support body comprising:

a leading portion having a forward surface with a leading point, the leading portion being oriented in an upstream direction with respect to the fluid flow when the seal member is in the fluid-flow position and orientation;

a trailing portion having a rearward surface with a trailing point, the trailing portion being oriented in a downstream direction with respect to the fluid flow when the seal member is in the fluid-flow position and orientation;

a transverse surface supporting the Belleville washer and oriented with the washer axis aligned with the aperture axis in the blocking position and orientation and with the washer axis at an angle to the fluid-flow axis when the seal member is in the fluid-flow position and orientation; and a support-body length measured perpendicular to the washer axis, wherein the support body has a thickness extending from the transverse surface to an opposite surface of the support body and a maximum thickness, and the thickness of the support body is tapered from a location of the maximum thickness toward the leading point of the support body, and a forward thickness taper distance from the point of maximum thickness to the leading point of the support body is less than 50 percent of the support-body length; and wherein the thickness of the support body is tapered from the location of maximum thickness toward the trailing point of the support body, and a rearward thickness taper distance from the point of maximum thickness to the trailing point of the support body is greater than the forward thickness taper distance.

2. The fire-protection system according to claim 1, wherein the support body has a width extending perpendicular to both the support-body length and the washer axis; and wherein the support body has a maximum width, and the width of the support body is tapered from a location of the maximum width toward the leading point of the support body, and a forward width taper distance from the point of maximum width to the leading point of the support body is less than 50 percent of the support-body length; and wherein the width of the support body is tapered from the location of maximum width toward the trailing point of the support body, and a rearward width taper distance from the point of maximum width to the trailing point of the support body is greater than the forward width taper distance.

3. The fire-protection system of claim 2, further comprising:

a movable base, the movable base being axially movable in translation parallel to the fluid-flow axis with respect to the valve, and a transverse support member fixed to the movable base and pivotably supporting the support body with respect to the movable base.

4. The fire-protection system according to claim 2, wherein the trailing portion of the support body comprises at least one of a frustoconical trailing portion, a parabolic trailing portion, and a curved trailing portion.

5. The fire-protection system according to claim 2, wherein the leading portion of the support body comprises at least one of a frustoconical trailing portion, a parabolic trailing portion, and a curved trailing portion.

6. The fire-protection system according to claim 1, further comprising:

a movable base, the movable base being axially movable in translation parallel to the fluid-flow axis with respect to the valve, and a transverse support member fixed to the movable base and pivotably supporting the support body with respect to the movable base.

7. The fire-protection system according to claim 6, wherein the transverse support member engages the support body for pivoting about a point located within a first 50 percent of the support-body length as measured parallel to the fluid-flow axis when the seal member is in the fluid-flow orientation.

8. The fire-protection system according to claim 6, wherein the transverse support member engages the support body for pivoting about a point located within a first 25 percent of the support-body length as measured parallel to the fluid-flow axis when the seal member is in the fluid-flow orientation.

9. The fire-protection system according to claim 6, further comprising:

a biasing member configured for exerting a torque on the support body rotating the support body with respect to the movable base to orient the leading portion in the upstream direction with respect to the fluid flow and the trailing portion in the downstream direction with respect to fluid flow.

10. The fire-protection system according to claim 9, wherein the transverse surface of the support body has a different shape or geometry than an opposite surface of the support body.

11. The fire-protection system according to claim 6, wherein the movable base is tubular and aligned with the fluid-flow axis for fluid flow therethrough.

12. The fire-protection system according to claim 1, wherein the trailing portion of the support body comprises at least one of a frustoconical trailing portion, a parabolic trailing portion, and a curved trailing portion.

13. The fire-protection system according to claim 12, further comprising:

a biasing member configured for exerting a torque on the support body to rotate the support body with respect to the movable base to orient the leading portion in the upstream direction with respect to the fluid flow and the trailing portion in the downstream direction with respect to fluid flow.

14. The fire-protection system according to claim 1, wherein the leading portion of the support body comprises at least one of a frustoconical portion, a parabolic portion, and a curved portion.

15. The fire-protection system according to claim 14, further comprising:

a biasing member configured for exerting a torque on the support body to rotate the support body with respect to the movable base to orient the leading portion in the upstream direction with respect to the fluid flow and the trailing portion in the downstream direction with respect to fluid flow.

16. A fire-protection system for delivering a fire-control fluid, the fire-protection system comprising:

a valve having a body with a fluid aperture having an aperture axis, and a fluid-flow axis parallel to a direction of flow of fluid through the fluid aperture;

a seal member supportable to close the fluid aperture, the seal member having a blocking position and orientation, the seal member preventing a fluid flow through the aperture in a pre-activation condition of the fire-protection system when in the blocking position and orientation, the seal member being movable from the blocking position and orientation to a fluid-flow position and orientation in an activated condition of the fire-protection system, the seal member comprising:

a Belleville washer having an aperture and a washer axis passing through the center of the aperture, perpendicular to the Belleville washer; and a support body comprising:

a leading portion having a forward surface with a leading point, the leading portion being oriented in an upstream direction with respect to the fluid flow when the seal member is in the fluid-flow position and orientation;

a trailing portion having a rearward surface with a trailing point, the trailing portion being oriented in a downstream direction with respect to the fluid flow when the seal member is in the fluid-flow position and orientation;

a transverse surface supporting the Belleville washer and oriented with the washer axis aligned with the aperture axis in the blocking position and orientation and with the washer axis at an angle to the fluid-flow axis when the seal member is in the fluid-flow position and orientation;

a support-body length measured perpendicular to the washer axis, wherein the support body has a width extending perpendicular to both the support-body length and the washer axis;

wherein the support body has a maximum width, and the width of the support body is tapered from a location of the maximum width toward the leading point of the support body, and a forward width taper distance from the point of maximum width to the leading point of the support body is less than 50 percent of the support-body length; and wherein the width of the support body is tapered from the location of maximum width toward the trailing point of the support body, and a rearward width taper distance from the point of maximum width to the trailing point of the support body is greater than the forward width taper distance.

17. The fire-protection system of claim 16, further comprising:

a movable base, the movable base being axially movable in translation parallel to the fluid-flow axis with respect to the valve, and a transverse support member fixed to the movable base and pivotably supporting the support body with respect to the movable base.

18. The fire-protection system according to claim 16, wherein the trailing portion of the support body comprises at least one of a frustoconical trailing portion, a parabolic trailing portion, and a curved trailing portion.

19. The fire-protection system according to claim 16, wherein the leading portion of the support body comprises at least one of a frustoconical trailing portion, a parabolic trailing portion, and a curved trailing portion.

* * * * *